United States Patent [19]

Vits

[11] 3,943,639

[45] Mar. 16, 1976

[54] AIR NOZZLE FOR DRYING A FABRIC WEB SUPPORTED ON SUPPORTING MEANS

[75] Inventor: Hilmar Vits, Leichlingen, Germany

[73] Assignee: Vits-Maschinenbau, Germany

[22] Filed: Nov. 12, 1973

[21] Appl. No.: 415,169

[30] Foreign Application Priority Data

Nov. 16, 1973 Germany ..... 2256087

[52] U.S. Cl. ..... 34/155; 34/DIG. 13; 239/560

[51] Int. Cl.[2] ..... F26B 13/02

[58] Field of Search..... 34/DIG. 13, 155, 160; 239/560, 561, 556, 557

[56] References Cited

UNITED STATES PATENTS

| | | | |
|---|---|---|---|
| 1,506,414 | 8/1924 | Dashew | 239/561 |
| 2,254,751 | 9/1941 | Paradise | 239/59 |
| 2,591,621 | 4/1952 | Shegda | 34/160 |
| 2,709,112 | 5/1955 | Curtice | 239/557 |
| 3,462,851 | 8/1969 | Urbas et al. | 34/160 |
| 3,603,512 | 9/1971 | Ham | 239/561 |
| 3,895,449 | 7/1975 | Chance et al. | 239/560 |

FOREIGN PATENTS OR APPLICATIONS

| | | | |
|---|---|---|---|
| 210,087 | 9/1968 | U.S.S.R. | 239/561 |

*Primary Examiner*—Carroll B. Dority, Jr.
*Assistant Examiner*—Larry I. Schwartz
*Attorney, Agent, or Firm*—Holman & Stern

[57] ABSTRACT

An air nozzle for drying a fabric web supported on a supporting frame has a nozzle head which is arranged transversely in relation to the fabric web. This nozzle head has a number of rows of adjacent nozzle holes extending in the nozzle head direction and located on the side facing the fabric web. The blowing direction of the nozzle holes in the discharge direction of the air blast, from the nozzle center to the edges thereof, decreases in steepness from one row to the next. Nozzle holes located in the same row have the same cross-section, where the cross-section of the individual nozzle holes, measured from the center of the air nozzle to the nozzle edges, increases from row to row. The total cross-section of the nozzle holes of each row, however, is constant, and the distance of the nozzle holes from the point of impingement of the appropriate jet core, from the center of the air nozzle to the nozzle edges, progressively increases from row to row. The nozzle holes may be provided in a perforated plate which has a number of strips which are bevel-edged at different angles. One of the aforementioned rows of nozzle holes is located in a respective one of the strips.

4 Claims, 7 Drawing Figures

AIR NOZZLE FOR DRYING A FABRIC WEB SUPPORTED ON SUPPORTING MEANS

BACKGROUND OF THE INVENTION

The invention relates to an air nozzle for drying a fabric web supported on supporting means, comprising a nozzle head which is arranged transversely in relation to the fabric web, and which has a number of rows of adjacent nozzle holes extending in the nozzle head direction, and located on the side facing the fabric web.

In a known nozzle arrangement of this kind, the discharge direction of each nozzle hole is parallel, and perpendicular to the fabric web, or the jets are inclined towards one another, so that a high static pressure is produced between the air nozzle and the fabric web. This high static pressure causes a steep pressure gradient at the edges of the air nozzle, with the result that the air blast is discharged at a high speed from the area between the fabric web and the sir nozzle, thus allowing suction forces to act on the fabric web. The suction forces load the fabric web, depending on its properties, either to a greater or lesser degree, and pull it towards the air nozzle (aerofoil effect), which decreases the discharge cross-section, and further increases the discharge rate and hence the suction forces. Webs of material, which have low stability of shape and tensile strength (e.g. woven goods still wet from printing, non-woven fabric, mica pulp, paper pulp), and which are therefore transported through the air-blast area of the air nozzle on a travelling base as carrier, e.g. a belt or roller, do not tolerate aerodynamic loading, or only low aerodynamic loading. This is because tensile stress can lead to tearing of the fabric web, or lift-off of the web whilst the woven goods are still wet from printing, which can involve the danger of the print becoming smudged, and therefore, up till now, the suction forces acting on the fabric web have been kept as low as possible, by maintaining a low speed of air blast by reducing the rate of the air supply. However, with this method it was also accepted that the degree of drying which is directly dependent on the air blast quantity, deteriorated.

SUMMARY OF THE INVENTION

On the basis of this prior art, the object of the invention is to create an air nozzle of the type initially described, with which a fabric web can be dried at a high speed of the air blast, with aerodynamic loading at the lowest possible level.

This objective is achieved in accordance with the invention, in that the blowing direction of the nozzle holes in the discharge direction of the air blast, from the nozzle center to the edges, decreases in steepness from one row to the next.

The air nozzle in accordance with the invention enables the fabric web to be dried with high efficiency, because the air blast effecting the drying can be directed at the fabric web at high speed, without the fabric web being subjected to such aerodynamic loads that are capable of impairing the quality of the fabric web. By comparison, the known nozzle could be operated only at less than 10 m/sec air speed, without causing inadmissibly high loading of the fabric web, whereas the air nozzle according to the invention permits an air speed of 40 m/sec without the fabric web becoming inadmissibly loaded.

The invention is based on realization of the fact that in the case of the initially mentioned, known air nozzle, lift-off of the fabric web and hence local displacement of the fabric web on the carrier surface, can be attributed to the fact that the air blast discharged at the two edges of the air nozzle, has too high a speed as a result of too steep a pressure gradient. The steep pressure gradient is produced because from the center of the air nozzle towards the two edges, the air blast supplied in parallel jets perpendicularly to the fabric web, is subjected to an excessive back-pressure in the nozzle area due to the jets. In the case of the air nozzle according to the invention on the other hand, the static pressure from the center of the air nozzle in the direction of the edges, is kept relatively low, but always above atmospheric pressure, where the reduction of static pressure caused locally on the fabric web by blast jets, stays lower than the accumulation of static pressure by partial blockage of the discharge of blast air between the individual jets of the nozzle rows. The jets, which are less steeply inclined towards the nozzle edges, present progressively lower resistance to the discharged blast air, so that at the edge, a sharp pressure gradient, and hence the otherwise caused lift-off of the fabric web, or other aerodynamic loading, is avoided.

A design form of the invention which in respect of the aerodynamic loading of the fabric web, is distinguished by especially advantageous conditions over the entire working range of the air nozzle, is characterised in that the nozzle holes located in the same row, have the same cross-section, where the cross-section of the individual nozzle holes, measured from the center of the air nozzle to the nozzle edges, increases from row to row, where the total cross-section of the nozzle holes of each row is constant, and where the distance of the nozzle holes from the point of impingement of the appropriate jet core on the fabric web, from the center of the air nozzle to the nozzle edges, progressively increases from row to row.

From the design point of view, a simple solution for the arrangement of the nozzle holes with different discharge directions, consists in placing the nozzle holes in a perforated plate which has a number of strips which are bevel-edged at different angles, in each of which a row of nozzle holes is located.

BRIEF DESCRIPTION OF THE DRAWINGS

In the following, the invention will be illustrated in greater detail with the aid of a drawing of one design form, where.

DESCRIPTION OF THE PREFERRED EMBODIMENTS

Figure 1:
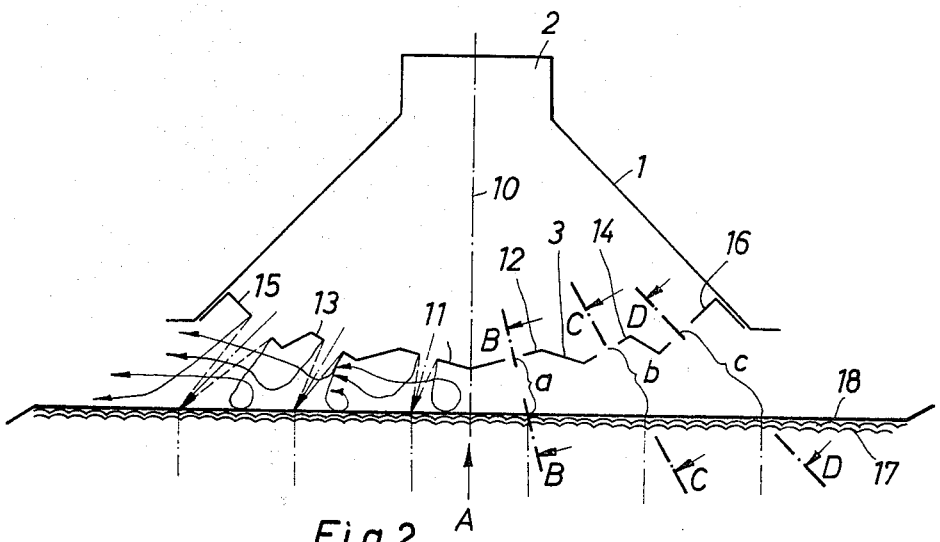
FIG. 1 shows an elevation of an air nozzle, viewed in the axial direction.

The air nozzle according to the invention is designed as a hollow nozzle body, comprising a wind box 1 with a substantially V-shaped cross-section, the said windbox having on its rear side an opening 2 for the supply of blast air, and on its front side, a nozzle plate 3. The nozzle plate 3 consists of a perforated metal sheet, the holes of which are arranged in several adjacent, parallel rows 4, 5, 6, 7, 8, 9 running transversely to the fabric web. The nozzle plate 3 is bevel-edged a number of times in the longitudinal direction, alternately to the right and left, as illustrated in the drawing, so that the nozzle rows 4, 5, 6, 7, 8, 9 lie in planes 11, 12, 13, 14, 15, 16 which have a backwardly slanting bevel of 15°, 30° or 45° respectively, relative to the symmetrical plane 10 of the air nozzle. As the axes of the nozzle holes which determine the direction of the air blast from the nozzle holes, intersect planes 10 to 16 perpendicularly, the direction of the air blast of the nozzle holes is correspondingly inclined, so that the air blast from the nozzle holes impinges progressively less steeply from row to row, from the center of the air nozzle to the edges, onto the fabric web 18 carried on a moving base 17. The distance *a, b, c* of the nozzle holes from the point of impingement of the jet cores on the fabric web 18, and the cross-section of the individual nozzle holes progressively increase in size, from the center of the air nozzle to its edges, from row to row, while the total cross-section of the nozzle holes of each of rows 4 to 9 remains constant (cf. in particular FIGS. 1 and 2). Between adjacent air nozzles 19*a, b*, there is always a perforated metal sheet 20 provided to cover the whole gap.

Figure 2:
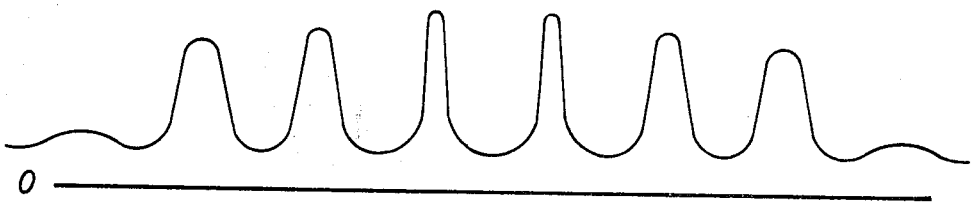
FIG. 2 shows a pressure diagram of the air nozzle according to FIG. 1, from one edge to the other, viewed in the direction of the fabric web.
Figure 3:
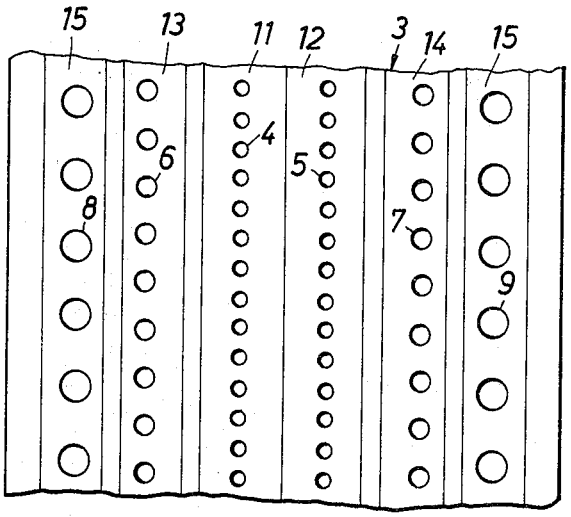
FIG. 3 shows a section of the air nozzle according to FIG. 1, seen in the direction of the arrow A.
Figure 4:
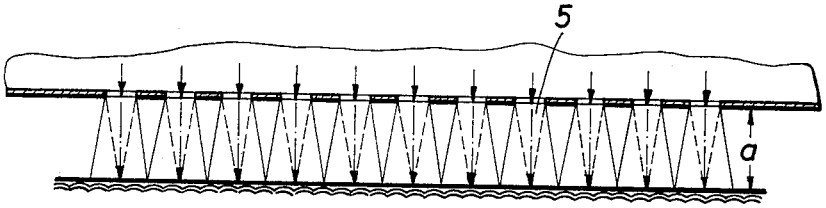
FIG. 4 shows a section through the air nozzle according to FIG. 1, along line B—B.
Figure 5:
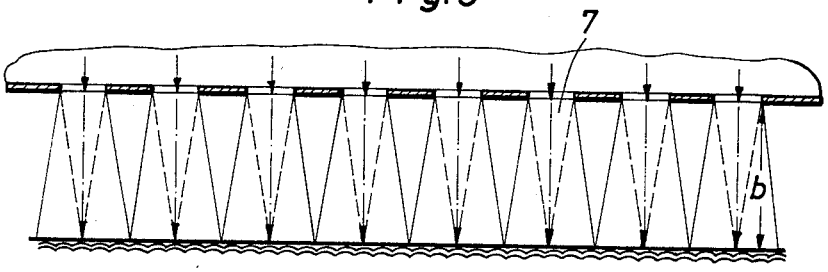
FIG. 5 shows a section through the air nozzle according to FIG. 1, along line C—C.
Figure 6:
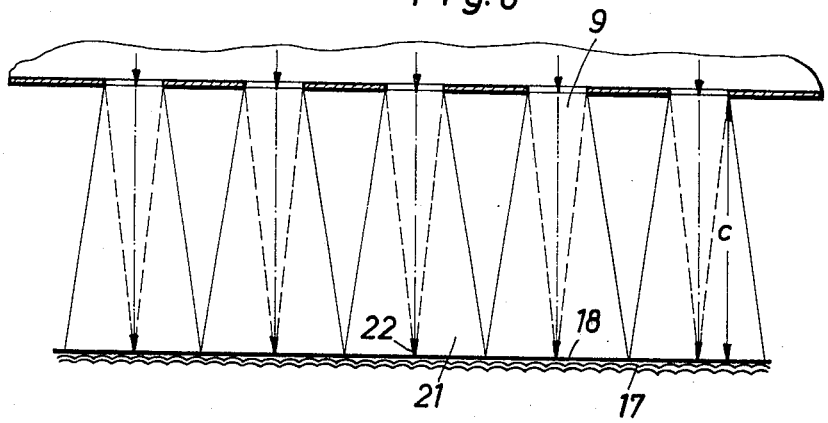
FIG. 6 shows a section through the air nozzle according to FIG. 1, along line D—D.
Figure 7:
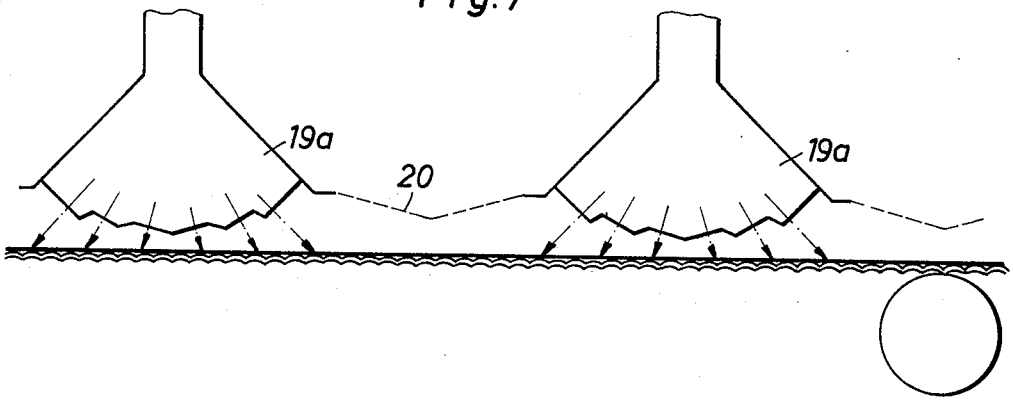
FIG. 7 shows two adjacent air nozzles according to FIG. 1, in elevation, these being linked with one another by means of a perforated metal sheet.

The air blast blown from the air nozzle at the fabric web 18, builds up a static pressure between the fabric web 18 and the nozzle plate 3, and this presses the fabric web against the moving base 17. When this happens, the pressure conditions represented by the diagram in FIG. 2, are produced. A static pressure maximum is produced at every point of impingement of the air jets on the fabric web 18. Despite the fact that from the center of the air nozzle to the edges, the discharged air blast quantity progressively increases, the static pressure remains above zero even in the areas of minimum pressure, so that the fabric web 18 is pressed onto the moving base 17 in the entire working range of the air nozzle, and is nowhere exposed to suction forces, which would lift the fabric web 18 off the moving base 17. As illustrated in FIGS. 3, 4, 5 and 6, a sufficiently open flow cross-section 21 is left for the discharged air blast between the adjacent air jets, due to the distance of the appropriate nozzle holes which increases towards the edges, and this flow cross-section 21 must be at its maximum at the outer rows (cf. flow arrows in FIG. 1) due to the maximum blast air quantity. The distance of the nozzle holes from the fabric web 18 is here adjusted such that the air jets impinge on the fabric web 18 with their core tips 22.

In order to further reduce the pressure gradient at the edges of the air nozzle, the gap between adjacent air nozzles 19*a*, 19*b* is covered over by a perforated metal sheet 20.

The properties of the moving base 17 depend on the nature of the fabric web 18. It may be an inextensible belt or drum. In the case of porous webs, it must have a greater porosity than the fabric web.

I claim:

1. Air nozzle for drying a fabric web supported on a supporting means, comprising a nozzle head which is arranged transversely in relation to the fabric web, and which has a number of rows of adjacent nozzle holes extending in the nozzle head direction and located on the side facing the fabric web, characterised in that the blowing direction of the nozzle holes in the discharge direction of the air blast, from the nozzle center to the edges, decreases in steepness from one row to the next, nozzle holes located in the same row having the same cross-section, where the cross-section of the individual nozzle holes, measured from the center of the air nozzle to the nozzle edges, increases from row to row, where the total cross-section of the nozzle holes of each row is however constant, and where the distance of the nozzle holes from the point of impingement of the appropriate jet core, from the center of the air nozzle to the nozzle edges, progressively increases from row to row.

2. Air nozzle in accordance with claim 1, characterized in that the nozzle holes are provided in a perforated plate which has a number of strips which are bevel-edged at different angles, and each of which one row (4, 5, 6, 7, 8, 9) of nozzle holes is located.

3. In combination with a supporting means, an air nozzle for drying a fabric web supported on the supporting means, the air nozzle comprising an elongate nozzle head which is arranged transversely to the fabric web, and which has a number of rows of adjacent nozzle holes extending in the nozzle head direction and located on the side facing the fabric web, characterized in that the nozzle holes in the same row have the same cross-section, the cross-section of the individual nozzle holes, measured from the center of the air nozzle to the transverse nozzle edges, increases from row to row, the blowing direction of the nozzle holes in the discharge direction of the air blast, from the nozzle center to the transverse edges, decreases in steepness from one row to the next, the nozzle holes being provided in a perforated plate which has a number of strips which have a backwardly slanting bevel at predetermined angles relative to a plane of symetry of the air nozzle, in each of which strips one row (4, 5, 6, 7, 8, 9) of nozzle holes is located, and a flow component of each air blown stream is directed toward the nxet outer air blown stream of the rows of the nozzle head.

4. Air nozzle for drying a fabric web which is supported on a supporting means, the nozzle comprising an elongate nozzle member transversely arranged in relation to the fabric web, the nozzle member being provided with a multitude of substantially straight, substantially planar strips, each provided with a row of adjacent nozzle holes which extend along the longitudinal direction of the member and having axes which intersect the planar strips perpendicularly, characterized in that the nozzle holes located in the same row have the same cross-section, the cross-section of the individual nozzle holes measured from the center of the air nozzle to the longitudinal edges, increases from row to row, the discharge direction, and thus, the direction of the nozzle holes is less inclined in the flow-direction of the blown air from the nozzle center to the transverse edges of the nozzle member from row to row of the nozzle member, whereby a flow component of each one blown-air stream is directed toward the next outer ones of the rows of the nozzle member.

* * * * *

UNITED STATES PATENT OFFICE

CERTIFICATE OF CORRECTION

Patent No. 3,943,639 Dated March 16, 1976

Inventor(s) Hilmar VITS

It is certified that error appears in the above-identified patent and that said Letters Patent are hereby corrected as shown below:

Kindly cancel the incorrect Priority Date and substitute therefor -- November 16, 1972 --.

Signed and Sealed this

First Day of February 1977

[SEAL]

*Attest:*

RUTH C. MASON
*Attesting Officer*

C. MARSHALL DANN
*Commissioner of Patents and Trademarks*